US008105128B1

(12) United States Patent
Sorensen et al.

(10) Patent No.: US 8,105,128 B1
(45) Date of Patent: Jan. 31, 2012

(54) INJECTION MOLDED TOY BUILDING ELEMENT

(76) Inventors: Soren Christian Sorensen, San Diego, CA (US); Jens Ole Sorensen, Rancho Santa Fe, CA (US)

( * ) Notice: Subject to any disclaimer, the term of this patent is extended or adjusted under 35 U.S.C. 154(b) by 1138 days.

(21) Appl. No.: 11/351,695

(22) Filed: Feb. 10, 2006

(51) Int. Cl.
*A63H 33/12* (2006.01)

(52) U.S. Cl. ..... 446/128; 446/122

(58) Field of Classification Search ..... 446/128
See application file for complete search history.

(56) References Cited

U.S. PATENT DOCUMENTS

| | | | | |
|---|---|---|---|---|
| 3,162,973 | A | 12/1964 | Christiansen | |
| 3,597,875 | A * | 8/1971 | Christiansen | 446/128 |
| 3,719,003 | A * | 3/1973 | Skjoldborg | 446/121 |
| 3,962,817 | A | 6/1976 | Vullierme | |
| D370,503 | S | 6/1996 | Burns | |
| 6,050,044 | A * | 4/2000 | McIntosh | 52/591.1 |
| 6,086,444 | A | 7/2000 | Glickman | |
| 6,200,187 | B1 * | 3/2001 | Olsen et al. | 446/122 |
| 6,511,073 | B2 | 1/2003 | Simonds | |
| 6,645,033 | B1 | 11/2003 | Thomsen | |

FOREIGN PATENT DOCUMENTS

| | | |
|---|---|---|
| GB | 676469 | 7/1952 |

* cited by examiner

*Primary Examiner* — Gene Kim
*Assistant Examiner* — Michael Dennis
(74) *Attorney, Agent, or Firm* — Edward W. Callan

(57) ABSTRACT

A toy building element includes side walls, a top having an upper surface that extends from the side walls, and a plurality of projections extending upward from the extensive upper surface, an open bottom and an interior. The interior is accessible through the open bottom for receiving a plurality of projections of another building element of a set of toy building elements. The interior includes a plurality of hollow members that extend downward from a respective portion of the extensive upper surface that is disposed between two of the projections; and the hollow members are open to the extensive upper surface. The hollow members partition the interior into regions in which a plurality of projections of another building element is received; and the regions of the building element are disposed directly below the projections of the same building element for receiving the projections of the other building element.

7 Claims, 2 Drawing Sheets

INJECTION MOLDED TOY BUILDING ELEMENT

BACKGROUND OF THE INVENTION

The present invention generally pertains to assembly toys and is particularly directed to an improved injection molded toy building element for a set of toy building elements that are capable of being interconnected in a releasable engagement.

Examples of prior art interconnectable toy building elements are described in U.S. Pat. Nos. 3,162,973; 6,050,044 and 6,645,033. The toy building elements disclosed in these patents individually include side walls; a top having an upper to surface that extends from the side walls, and a plurality of projections extending upward from the extensive upper surface; an open bottom; and an interior that is accessible through said open bottom for receiving a plurality of said projections of another said building element of said set; wherein the interior includes a plurality of contact surfaces that are disposed for interconnecting in a releasable engagement with said received projections; and wherein the interior further includes at least one hollow member that extends downward from a portion of the extensive upper surface that is disposed between at least two of said projections.

SUMMARY OF THE INVENTION

In one aspect, the present invention provides an injection molded toy building element for a set of toy building elements that are capable of being interconnected in a releasable engagement, comprising: side walls; a top having an upper surface that extends from the side walls, and a plurality of projections extending upward from the extensive upper surface; an open bottom; and an interior that is accessible through said open bottom for receiving a plurality of said projections of another said building element of said set; wherein the interior includes a plurality of contact surfaces that are disposed for interconnecting in a releasable engagement with said received projections; wherein the interior includes at least one hollow member that extends downward from a portion of the extensive upper surface that is disposed between at least two of said projections; wherein the at least one hollow member is open through the extensive upper surface; and wherein the hollow member has an outward slope in a direction extending from the bottom toward the top.

In another aspect, the present invention provides injection molded toy building element for a set of toy building elements that are capable of being interconnected in a releasable engagement, comprising: side walls; a top having an upper surface that extends from the side walls; an open bottom; and an interior having a plurality of regions that are accessible through said open bottom for receiving a plurality of projections extending upward from the extensive upper surface of another said building element of said set; wherein the interior includes a plurality of contact surfaces that are disposed for interconnecting in a releasable engagement with said received projections; wherein the interior further includes at least one hollow member that extends downward from the extensive upper surface and partitions the interior into at least two said regions in which said at least two of said projections are received; wherein the at least one hollow member is open through the extensive upper surface; and wherein the hollow member has an outward slope, in a direction extending from the bottom toward the top.

The toy building element of the present invention is particularly suited for injection molding in that the feature of the at least one hollow member being open to the extensive upper surface facilitates formation of the at least one hollow member and the removal thereof from the mold parts.

Additional features of the present invention are described with reference to the detailed description of the preferred embodiments.

DETAILED DESCRIPTION

Figure 1:
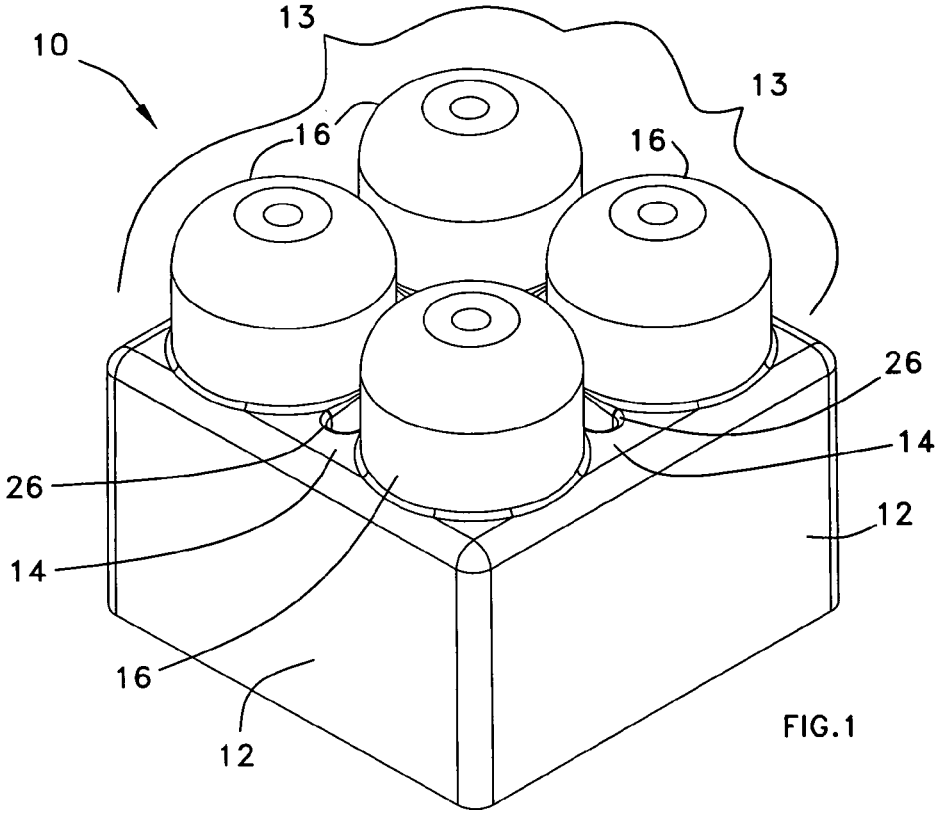
FIG. 1 is a top and two-sided perspective view of a preferred embodiment of a building element according to the present invention.
Figure 2:
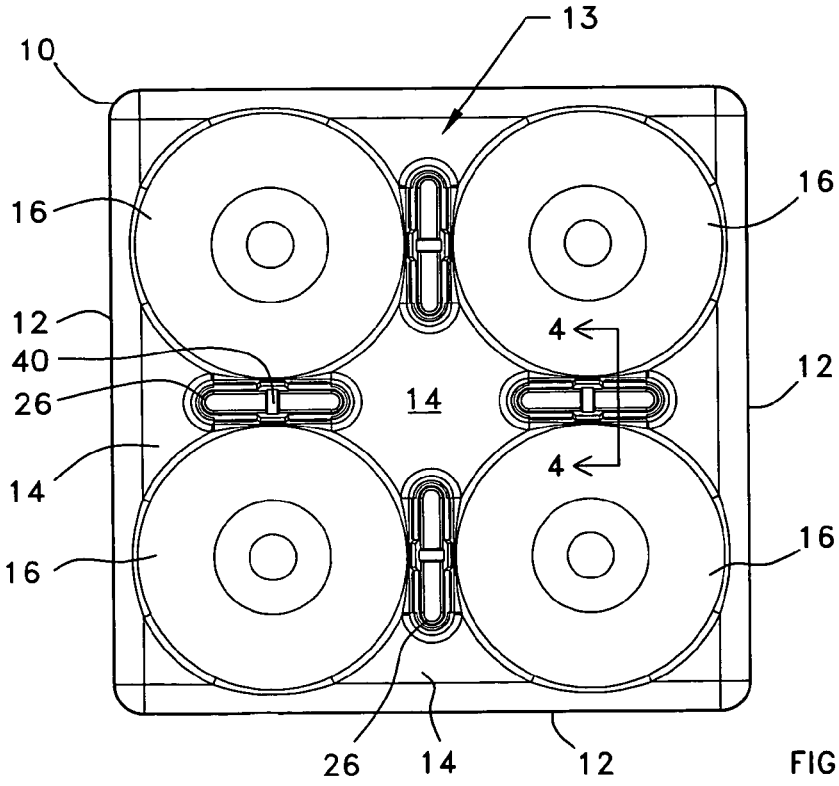
FIG. 2 is a top view of the building element of FIG. 1.
Figure 3:
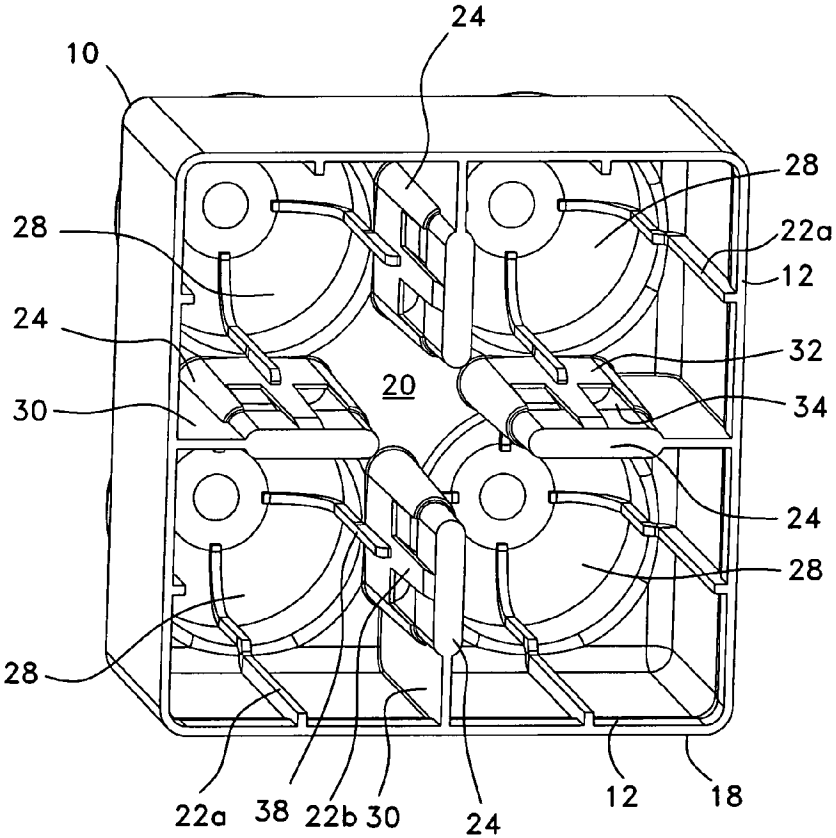
FIG. 3 is a bottom perspective view of the building element of FIG. 1.

Referring to FIGS. 1 through 3, one preferred embodiment of a toy building element 10 according to the present invention includes side walls 12; a top 13 having an upper surface 14 that extends from the side walls 12, and a plurality of projections 16 extending upward from the extensive upper surface 14, an open bottom 18 and an interior 20. The interior 20 is accessible through the open bottom 18 for receiving a plurality of projections 16 of another building element 10 of a set of toy building elements. The interior 20 includes a plurality of contact surfaces 22*a*, 22*b* that are disposed for interconnecting in a releasable engagement with the projections 16 of another building element 10 of the set that is received in the interior 20.

The interior 20 further includes a plurality of hollow members 24 that extend downward from a respective portion 26 of the extensive upper surface 14 that is disposed between two of the projections 16; and the hollow members 24 are open to the extensive upper surface 14.

The hollow members 24 partition the interior 20 into regions 28 in which a plurality of projections 16 of one or more other building elements 10 of the set are received; and the regions 28 are disposed directly below the projections 16 of the building element 10 for receiving the projections 16 of another building element 10 of the set of toy building elements 10.

In an alternative embodiment (not shown), an individual building element includes two projections extending upward from the extensive upper surface and a single hollow member that extends downward from a portion of the extensive upper surface that is disposed between the two projections; the hollow member is open to the extensive upper surface; the hollow member partitions the interior into two regions in which two projections of one or two other building elements of the set are received; and the regions are disposed directly below the projections of the individual building element for receiving the projections of another building element of the set of toy building elements.

In other alternative embodiments (not shown), individual building elements include one or more rows of more than two projections extending upward from the extensive upper surface and hollow members that extends downward from portions of the extensive upper surface that are disposed between at least two of the projections; the hollow members are open to the extensive upper surface; the hollow members partition the interior into more than two regions in which projections of one or more other building elements of the set are received; and the regions are disposed directly below the projections of the individual building element for receiving the projections of another building element of the set of toy building elements.

Still other embodiments of the building element of the present invention are made as described above with reference to the embodiment of FIGS. 1, 2 and 3 and the different alternative embodiments, except that there are no projections extending from the extensive upper surface.

The individual hollow members 24 have an outward slope in a direction from the bottom 18 toward the top 13, to thereby enhance the removal of building element from the mold parts. In alternative embodiments, the hollow members 24 do not have an outward slope.

The interior 20 also includes a plurality of webs 30 that respectively secure one of the hollow members 24 to an adjacent sidewall 12 and thereby enhance the positional stability of the hollow members 24 and the sidewalls 12.

In the preferred embodiment, it is seen in FIG. 3 that the hollow members 24 are not laterally connected to one another. In alternative embodiments (not shown), the hollow members are laterally connected to one another. However, such alternative embodiments require more plastic material than the preferred embodiment.

In the preferred embodiment the contact surfaces 22*a* on the sidewalls 12 are provided by ribs and the contact surfaces 22*b* on the hollow members 24 are provided by ribless surfaces on the sides of the lower portion of the hollow members 24, as shown in FIG. 3. In alternative embodiments (not shown), there are no ribs on the sidewalls 12 and/or there are ribs on the sides of the lower portions of the hollow members respectively. It is preferable that ribs be provided on the sidewalls 12 for both enhancing the releasable engagement of projections 16 in the regions 28 of the interior 20 and for enhancing the strength of the sidewalls 12. Also the ribs on the sidewalls 12 are provided by including flow channels in the mold part that forms the interior 20 of the building element 10; and such flow channels improve the flow of plastic material within the mold cavity during the injection of the plastic material.

There are also ribs 38 on the sides of the upper portion of the hollow members 24 and on the interior surfaces of the projections 16, as shown in FIG. 3. The ribs 38 enhance the physical stability of the building element 10; and flow channels that are included in the interior-surface-forming mold part in order to provide the ribs 38 improves the flow of plastic material within the mold cavity to the tops of the projections 16 during the injection of the plastic material.

The individual hollow members 24 include a wall 40 that is centrally located to strengthen the hollow member 24, as shown in FIG. 2. In alternative embodiments (not shown) the individual hollow members do not include such a wall.

The individual hollow members 24 have a closed bottom, as shown in FIG. 3. In alternative embodiments (not shown) the individual hollow members have an open bottom.

The amount of curvature with which the extensive upper surface 14 extends from the sidewalls 12 may be more or less than that shown in FIG. 1, and in some embodiments there is no appreciable curvature, but merely a small rounding of the edges between extensive upper surface 14 and the sidewalls 12.

The toy building element of the present invention is made by injection molding of plastic material into a mold defined by first and second mold parts. The first mold part forms the surfaces of the interior 20 of the building element 10 shown in FIG. 3, including the exteriors of the hollow members 24 and the interiors of the projections 16. The second mold part forms the exterior surfaces of the sidewalls 12 and the top 13 of the building element 10 shown in FIGS. 1 and 2, including the interiors of the hollow members 24 and the exteriors of the projections 16.

Separate mold parts are used to form the hollow members 24 so that the hollow members 24 with very thin walls can be readily removed from the mold parts. If hollow members 24 having very thin walls were to be formed in a single mold part it would more difficult to remove the hollow members from the single mold part.

An individual hollow member 24 has sidewalls 32 that define a pair of lateral windows 34 through the hollow member 24. This feature results from the configuration of mold parts, which are designed to enhance the stability of the mold parts with respect to one another during high-pressure injection of plastic material into the mold in which the toy building element is formed. In the preferred embodiment shown in FIGS. 3 and 4, there are two windows 34 in each of the two sidewalls 32 of each hollow member. In alternative embodiments (not shown), there may more or fewer lateral windows through the hollow building elements.

Figure 4:
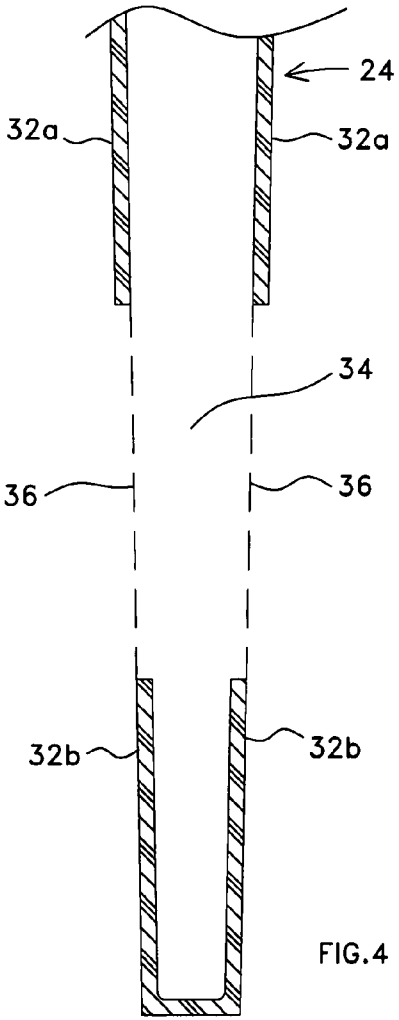
FIG. 4 is a partial sectional view of a hollow member of the building element of FIG. 1 taken in the direction of line 4-4 in FIG. 2.

Referring to the partial sectional view of the hollow member 24 shown in FIG. 4, dashed lines 36 are shown between upper segments 32*a* and lower segments 32*b* of the sidewalls of the hollow member 24. One of the lateral windows 34 through the hollow member 24 is defined between the upper segments 32*a* and the lower segments 32*b*. The dashed lines 36 indicate where the first and second mold parts contact one another to thereby enhance the positional stability of the first and second mold parts with respect to one another while the plastic material is being injected into the mold.

The benefits specifically stated herein do not necessarily apply to every conceivable embodiment of the present invention. Further, such stated benefits of the present invention are only examples and should not be construed as the only benefits of the present invention.

While the above description contains many specificities, these specificities are not to be construed as limitations on the scope of the present invention, but rather as examples of the preferred embodiments described herein. Other variations are possible and the scope of the present invention should be determined not by the embodiments described herein but rather by the claims and their legal equivalents. The claims require no implicit limitations. Each claim is to be construed explicitly as stated, or by its legal equivalent.

Applicants reserve the right to present claims to an injection molding method using mold parts having at least some of the features described herein.

The invention claimed is:

1. An injection molded toy building element for a set of toy building elements that are capable of being interconnected in a releasable engagement, comprising:

side walls;

a top having an upper surface that extends from the side walls, and a plurality of projections extending upward from the extensive upper surface;

an open bottom; and an interior that is accessible through said open bottom for receiving a plurality of said projections of another said building element of said set;

wherein the interior includes a plurality of contact surfaces that are disposed for interconnecting in a releasable engagement with said received projections;

wherein the interior further includes at least one hollow member that extends downward from a portion of the extensive upper surface that is disposed between at least two of said projections;

wherein the at least one hollow member is open through the extensive upper surface; and wherein the hollow member has an outward slope in a direction extending from the bottom toward the top.

2. A toy building element according to claim 1, wherein the interior includes at least one web that secures the at least one hollow member to an adjacent sidewall.

3. A toy building element according to claim 1, wherein, the hollow member has sidewalls that define a lateral window through the hollow member.

4. A toy building element according to claim 1, wherein the at least one hollow member partitions at least two regions of the interior in which said at least two of said projections are received; and wherein the at least two regions are disposed directly below at least two projections of said building element for receiving said at least two projections of another said building element of said set.

5. An injection molded toy building element for a set of toy building elements that are capable of being interconnected in a releasable engagement, comprising:

side walls;

a top having an upper surface that extends from the side walls;

an open bottom; and an interior having a plurality of regions that are accessible through said open bottom for receiving a plurality of projections extending upward from the extensive upper surface of another said building element of said set;

wherein the interior includes a plurality of contact surfaces that are disposed for interconnecting in a releasable engagement with said received projections;

wherein the interior further includes at least one hollow member that extends downward from the extensive upper surface and partitions the interior into at least two said regions in which said at least two of said projections are received; and wherein the at least one hollow member is open through the extensive upper surface; and wherein the hollow member has an outward slope in a direction extending from the bottom toward the top.

6. A toy building element according to claim 5, wherein the interior includes at least one web that secures the at least one hollow member to an adjacent sidewall.

7. A toy building element according to claim 5, wherein the hollow member has sidewalls that define a lateral window through the hollow member.

* * * * *